US012134938B2

(12) United States Patent
Duffy et al.

(10) Patent No.: US 12,134,938 B2
(45) Date of Patent: Nov. 5, 2024

(54) CUTTING ELEMENTS FOR EARTH-BORING TOOLS, METHODS OF MANUFACTURING EARTH-BORING TOOLS, AND RELATED EARTH-BORING TOOLS

(71) Applicant: Baker Hughes Oilfield Operations LLC, Houston, TX (US)

(72) Inventors: Stephen Duffy, Spring, TX (US); Nicholas J. Lyons, Houston, TX (US); Michael L. Doster, Spring, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 17/650,014

(22) Filed: Feb. 4, 2022

(65) Prior Publication Data

US 2022/0251905 A1 Aug. 11, 2022

Related U.S. Application Data

(60) Provisional application No. 63/146,531, filed on Feb. 5, 2021.

(51) Int. Cl.

| | |
|---|---|
| ***E21B 10/567*** | (2006.01) |
| ***E21B 10/43*** | (2006.01) |
| ***E21B 10/55*** | (2006.01) |
| ***E21B 10/573*** | (2006.01) |

(52) U.S. Cl.

CPC ..... *E21B 10/5673* (2013.01); *E21B 10/43* (2013.01); *E21B 10/55* (2013.01); *E21B 10/5735* (2013.01)

(58) Field of Classification Search

CPC ..... E21B 10/5673; E21B 10/5676

See application file for complete search history.

(56) References Cited

U.S. PATENT DOCUMENTS

| | | | |
|---|---|---|---|
| 4,109,737 | A | 8/1978 | Bevenkerk |
| 4,529,048 | A | 7/1985 | Hall |
| 4,570,726 | A | 2/1986 | Hall |
| 4,593,777 | A | 6/1986 | Barr |
| 4,872,520 | A | 10/1989 | Nelson |

(Continued)

FOREIGN PATENT DOCUMENTS

| | | |
|---|---|---|
| CN | 205259954 U | 3/2013 |
| CN | 205778558 | 12/2016 |

(Continued)

OTHER PUBLICATIONS

International Search Report for Application No. PCT/US2022/070538 dated May 10, 2022, 5 pages.

(Continued)

*Primary Examiner* — Robert E Fuller

(74) *Attorney, Agent, or Firm* — Baker Hughes Company

(57) ABSTRACT

A cutting element for downhole drilling and related earth-boring tool for downhole drilling. The cutting element may include a substrate and a polycrystalline diamond material affixed to the substrate at an interface. The polycrystalline diamond material may include a raised cutting surface having at least two cutting edges, and first transition surfaces between the at least two cutting edges of the raised cutting surface and a side surface of the cutting element. The first transition surfaces may include multiple planar surfaces.

20 Claims, 8 Drawing Sheets

(56) References Cited

U.S. PATENT DOCUMENTS 4,987,800 A 1/1991 Gasan et al.
4,989,578 A 2/1991 Lebourg
5,054,246 A 10/1991 Phaal et al.
5,172,778 A 12/1992 Tibbitts et al.
5,333,699 A 8/1994 Thigpen et al.
5,377,773 A 1/1995 Tibbitts
5,437,343 A 8/1995 Cooley et al.
5,449,048 A * 9/1995 Thigpen ..... E21B 17/1092 175/430
5,460,233 A * 10/1995 Meany ..... E21B 10/5673 175/428
5,467,836 A 11/1995 Grimes et al.
5,499,688 A 3/1996 Dennis
5,709,279 A 1/1998 Dennis
5,871,060 A 2/1999 Jensen et al.
5,881,830 A 3/1999 Cooley
6,045,440 A 4/2000 Johnson et al.
6,065,554 A 5/2000 Taylor et al.
6,196,340 B1 3/2001 Jensen et al.
6,202,770 B1 3/2001 Tibbitts
6,244,365 B1 6/2001 Southland
6,447,560 B2 * 9/2002 Jensen ..... B22F 7/06 51/293
6,481,952 B2 11/2002 Deutschle et al.
6,510,910 B2 1/2003 Eyre et al.
6,527,069 B1 3/2003 Meiners et al.
6,550,556 B2 4/2003 Middlemiss et al.
6,672,406 B2 1/2004 Beuershausen
6,929,079 B2 8/2005 McDonough et al.
6,935,444 B2 8/2005 Lund et al.
7,363,992 B2 4/2008 Stowe et al.
7,475,744 B2 1/2009 Pope
7,726,420 B2 6/2010 Shen et al.
7,740,090 B2 6/2010 Shen et al.
7,757,785 B2 7/2010 Zhang et al.
7,798,257 B2 9/2010 Shen et al.
8,037,951 B2 10/2011 Shen et al.
8,087,478 B2 1/2012 Patel
8,113,303 B2 2/2012 Zhang et al.
8,191,656 B2 6/2012 Dourfaye et al.
8,353,370 B2 1/2013 Bellin et al.
8,360,175 B2 1/2013 Fan et al.
8,499,860 B2 8/2013 Shen et al.
8,684,112 B2 4/2014 Digiovanni et al.
8,783,387 B2 7/2014 Durairajan et al.
8,833,492 B2 9/2014 Durairajan et al.
8,851,206 B2 10/2014 Patel
9,062,505 B2 6/2015 Chapman et al.
9,103,174 B2 8/2015 Digiovanni
9,145,743 B2 9/2015 Shen et al.
RE45,748 E 10/2015 Zhang et al.
9,243,452 B2 1/2016 Digiovanni et al.
9,376,867 B2 * 6/2016 DiGiovanni ..... E21B 10/5673
9,388,639 B2 7/2016 Patel et al.
9,404,310 B1 8/2016 Sani et al.
9,428,966 B2 8/2016 Patel et al.
9,441,422 B2 9/2016 DiSantis
9,598,909 B2 3/2017 Patel
9,650,837 B2 5/2017 Patel et al.
9,702,198 B1 7/2017 Topham
9,845,642 B2 12/2017 Stockey
10,017,994 B2 7/2018 Von et al.
10,022,840 B1 7/2018 Miess
10,125,552 B2 11/2018 Zhao et al.
10,240,399 B2 3/2019 Rahmani
10,287,825 B2 5/2019 Chen et al.
10,309,156 B2 6/2019 Azar et al.
10,378,289 B2 8/2019 Stockey
10,400,517 B2 9/2019 Borge
10,465,447 B2 11/2019 Stockey et al.
10,480,253 B2 11/2019 Vempati et al.
10,550,644 B2 2/2020 Drews et al.
10,570,668 B2 2/2020 Izbinski et al.
10,577,870 B2 3/2020 Izbinski et al.
10,605,010 B2 3/2020 De Maindreville et al.
10,753,157 B2 8/2020 Rahmani
10,794,118 B2 10/2020 Azar et al.
10,801,268 B2 10/2020 Rahmani et al.
10,907,416 B2 2/2021 Cheng et al.
11,035,177 B2 6/2021 Dubose et al.
11,060,356 B2 7/2021 Cuillier De Maindreville et al.
11,091,960 B2 8/2021 Zhang et al.
11,098,532 B2 8/2021 Gan et al.
11,208,849 B2 12/2021 Rahmani et al.
11,255,129 B2 2/2022 Dubose et al.
2001/0030063 A1 10/2001 Dykstra et al.
2003/0158018 A1 8/2003 Giannelli et al.
2004/0097532 A1 5/2004 Jesudason et al.
2004/0163851 A1 8/2004 McDonough et al.
2005/0269139 A1 12/2005 Shen et al.
2006/0157286 A1 7/2006 Pope
2006/0210364 A1 9/2006 Bellmann et al.
2006/0219439 A1 10/2006 Shen et al.
2007/0079995 A1 4/2007 McClain et al.
2008/0190666 A1 8/2008 Gatell
2008/0205804 A1 8/2008 Jeng
2008/0236900 A1 10/2008 Cooley et al.
2009/0057031 A1 3/2009 Patel et al.
2010/0059287 A1 3/2010 Durairajan et al.
2010/0084198 A1 4/2010 Durairajan et al.
2010/0288564 A1 11/2010 Dovalina et al.
2010/0300765 A1 12/2010 Zhang et al.
2010/0307829 A1 12/2010 Patel
2011/0031030 A1 2/2011 Shen et al.
2011/0031031 A1 2/2011 Vempati et al.
2011/0088950 A1 4/2011 Scott et al.
2011/0155472 A1 6/2011 Lyons et al.
2011/0171414 A1 7/2011 Sreshta et al.
2011/0259642 A1 10/2011 Digiovanni et al.
2011/0266070 A1 11/2011 Scott et al.
2011/0286810 A1 11/2011 Lancaster et al.
2012/0247834 A1 10/2012 Buxbaum et al.
2012/0325563 A1 12/2012 Scott et al.
2013/0068534 A1 3/2013 Digiovanni et al.
2013/0068537 A1 3/2013 Digiovanni
2013/0068538 A1 3/2013 Digiovanni et al.
2013/0292188 A1 11/2013 Bilen et al.
2013/0306377 A1 11/2013 Digiovanni et al.
2014/0041948 A1 2/2014 Shen et al.
2014/0048340 A1 2/2014 Digiovanni et al.
2014/0238753 A1 8/2014 Nelms et al.
2014/0246253 A1 9/2014 Patel et al.
2014/0318873 A1 10/2014 Patel et al.
2014/0366456 A1 12/2014 Chapman et al.
2015/0047913 A1 2/2015 Durairajan et al.
2015/0259986 A1 9/2015 Stockey
2015/0259988 A1 9/2015 Chen et al.
2015/0285007 A1 10/2015 Stockey et al.
2016/0069140 A1 3/2016 Patel et al.
2016/0108678 A1 4/2016 Von et al.
2016/0265285 A1 9/2016 Stockey et al.
2017/0175452 A1 6/2017 Vempati et al.
2017/0234078 A1 8/2017 Patel et al.
2018/0148978 A1 5/2018 Chen
2018/0274303 A1 9/2018 Song et al.
2018/0320450 A1 11/2018 Borge
2018/0355672 A1 12/2018 De Maindreville et al.
2019/0040689 A1 2/2019 Liang et al.
2019/0071933 A1 3/2019 Gan et al.
2019/0084087 A1 3/2019 Chapman et al.
2019/0106943 A1 4/2019 Tilleman et al.
2019/0112877 A1 4/2019 Gan et al.
2019/0309578 A1 10/2019 Borge
2019/0376346 A1 12/2019 Vijayavelan
2020/0032588 A1 1/2020 Izbinski et al.
2020/0032589 A1 1/2020 Izbinski et al.
2020/0157890 A1 5/2020 Cuillier De Maindreville et al.
2020/0224501 A1 7/2020 Dubose et al.
2020/0340303 A1 10/2020 Cheng et al.
2021/0131190 A1 5/2021 Rahmani et al.
2021/0156202 A1 5/2021 Gan et al.
2021/0172258 A1 6/2021 Graham et al.
2021/0180409 A1 6/2021 Davila et al.
2021/0215003 A1 7/2021 Mahajan et al.

(56) References Cited

U.S. PATENT DOCUMENTS

| | | | |
|---|---|---|---|
| 2021/0277722 | A1 | 9/2021 | Liu et al. |
| 2021/0370419 | A1 | 12/2021 | Yu et al. |
| 2021/0372203 | A1 | 12/2021 | Eyre et al. |
| 2021/0381318 | A1 | 12/2021 | Gan et al. |
| 2022/0003046 | A1 | 1/2022 | Yu et al. |
| 2022/0074271 | A1 | 3/2022 | Rahmani et al. |
| 2022/0112773 | A1 | 4/2022 | Chen et al. |
| 2022/0381092 | A1* | 12/2022 | Gan ..... E21B 10/5673 |

FOREIGN PATENT DOCUMENTS

| | | | |
|---|---|---|---|
| EP | 0121083 | A1 | 10/1984 |
| EP | 0572761 | A1 | 12/1993 |
| EP | 0893572 | B1 | 12/2003 |
| EP | 0841463 | B1 | 3/2004 |
| GB | 2339221 | A | 1/2000 |
| GB | 2369841 | A | 6/2002 |
| JP | 11-060667 | A | 3/1999 |
| JP | 2008-291222 | A | 12/2008 |
| JP | 5315838 | B2 | 10/2013 |
| WO | 97/30263 | A1 | 8/1997 |
| WO | 00/48789 | A1 | 8/2000 |
| WO | 2004/007901 | A1 | 1/2004 |
| WO | 2004/007907 | A1 | 1/2004 |
| WO | 2008/102324 | A1 | 8/2008 |
| WO | 2013/040123 | A1 | 3/2013 |
| WO | 2016/004136 | A1 | 1/2016 |
| WO | 2016/044136 | A1 | 3/2016 |
| WO | 2017/172431 | A2 | 10/2017 |
| WO | 2018/231343 | A1 | 12/2018 |
| WO | 2020/055882 | A1 | 3/2020 |
| WO | 2020/102016 | A1 | 5/2020 |
| WO | 2020/131421 | | 6/2020 |
| WO | 2020/245165 | A1 | 12/2020 |
| WO | 2020/245223 | A1 | 12/2020 |
| WO | 2021/041753 | A1 | 3/2021 |
| WO | 2021/080900 | A1 | 4/2021 |
| WO | 2021/091836 | A1 | 5/2021 |
| WO | 2021/142188 | A | 7/2021 |
| WO | 2021158218 | A1 | 8/2021 |
| WO | 2021/178304 | A1 | 10/2021 |
| WO | 2021/243361 | A1 | 12/2021 |
| WO | 2021/243362 | A1 | 12/2021 |

OTHER PUBLICATIONS

International Written Opinion for Application No. PCT/US2022/070538 dated May 10, 2022, 5 pages.

European Extended Search Report and Opinion for European Application No. 20917982.9, dated Sep. 18, 2023, 7 pages.

Liu et al., Chinese Patent No. CN-205778558-U, Dec. 2016, English Translation dated Nov. 16, 2023. (Year: 2016).

* cited by examiner

CUTTING ELEMENTS FOR EARTH-BORING TOOLS, METHODS OF MANUFACTURING EARTH-BORING TOOLS, AND RELATED EARTH-BORING TOOLS

CROSS-REFERENCE TO RELATED APPLICATION

This application claims the benefit under 35 U.S.C. § 119(e) of U.S. Provisional Patent Application Ser. No. 63/146,531, filed Feb. 5, 2021, the disclosure of which is hereby incorporated herein in its entirety by this reference.

TECHNICAL FIELD

This disclosure relates generally to cutting elements for earth-boring tools and related earth-boring tools and methods. More specifically, disclosed embodiments relate to configurations, designs, and geometries for cutting elements for earth-boring tools, which may increase cutting efficiency.

BACKGROUND

Wellbores are formed in subterranean formations for various purposes including, for example, extraction of oil and gas from the subterranean formation and extraction of geothermal heat from the subterranean formation. Wellbores may be formed in a subterranean formation using earth-boring tools, such as an earth-boring rotary drill bit. The earth-boring rotary drill bit is rotated and advanced into the subterranean formation. As the earth-boring rotary drill bit rotates, the cutting elements, cutters, or abrasive structures thereof cut, crush, shear, and/or abrade away the formation material to form the wellbore.

The earth-boring rotary drill bit is coupled, either directly or indirectly, to an end of what is referred to in the art as a "drill string," which comprises a series of elongated tubular segments connected end-to-end that extends into the wellbore from the surface of earth above the subterranean formations being drilled. Various tools and components, including the drill bit, may be coupled together at the distal end of the drill string at the bottom of the wellbore being drilled. This assembly of tools and components is referred to in the art as a "bottom-hole assembly" (BHA).

The earth-boring rotary drill bit may be rotated within the wellbore by rotating the drill string from the surface of the formation, or the drill bit may be rotated by coupling the drill bit to a downhole motor, which is coupled to the drill string and disposed proximate the bottom of the wellbore. The downhole motor may include, for example, a hydraulic Moineau-type motor having a shaft, to which the earth-boring rotary drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore. The downhole motor may be operated with or without drill string rotation.

Different types of earth-boring rotary drill bits are known in the art, including fixed-cutter bits, rolling-cutter bits, and hybrid bits (which may include, for example, both fixed cutters and rolling cutters). Fixed-cutter bits, as opposed to roller cone bits, have no moving parts and are designed to be rotated about the longitudinal axis of the drill string. Most fixed-cutter bits employ Polycrystalline Diamond Compact (PDC) cutting elements. The cutting edge of a PDC cutting element drills rock formations by shearing, like the cutting action of a lathe, as opposed to roller cone bits that drill by indenting and crushing the rock. The cutting action of the cutting edge plays a major role in the amount of energy needed to drill a rock formation.

A PDC cutting element is usually composed of a thin layer, (about 3.5 mm), of polycrystalline diamond bonded to a cutting element substrate at an interface. The polycrystalline diamond material is often referred to as the "diamond table." A PDC cutting element is generally cylindrical with a diameter from about 8 mm up to about 24 mm. However, PDC cutting elements may be available in other forms such as oval or triangle-shapes and may be larger or smaller than the sizes stated above.

A PDC cutting element may be fabricated separately from the bit body and secured within cutting element pockets formed in the outer surface of a blade of the bit body. A bonding material such as an adhesive or, more typically, a braze alloy may be used to secure the PDC cutting element within the pocket. The diamond table of a PDC cutting element is formed by sintering and bonding together relatively small diamond grains under conditions of high temperature and high pressure (HTHP) in the presence of a catalyst (such as, for example, cobalt, iron, nickel, or alloys and mixtures thereof) to form a layer or "table" of polycrystalline diamond material on the cutting element substrate.

BRIEF SUMMARY

In embodiments, cutting elements for earth-boring tools may include a substrate and a polycrystalline diamond material affixed to the substrate at an interface. The polycrystalline diamond material may have a raised cutting surface including at least two cutting edges, and first transition surfaces between the at least two cutting edges of the raised cutting surface and a longitudinal side surface of the cutting element. The first transition surfaces may include multiple planar surfaces.

In embodiments, a method of manufacturing earth-boring tools may include forming a drill bit body and forming at least one blade extending from one end of the drill bit body. The at least one blade comprising a leading edge section. Forming at least one cutting element in each at least one blade proximate the leading edge section of the at least one blade. Forming the at least one cutting element includes forming a polycrystalline diamond material, affixing a first end of the polycrystalline diamond material at an interface to a substrate, and shaping a second end of the polycrystalline diamond material. Shaping the second end of the polycrystalline diamond material includes forming at least two cutting edges defining a raised cutting surface, and forming first transition surfaces between the at least two cutting edges of the raised cutting surface and a longitudinal side surface of the cutting element, wherein the first transition surfaces comprise multiple planar surfaces.

In embodiments, earth-boring tools may include a bit body, a plurality of blades extending from one end of the body, each blade comprising a leading edge section, at least one cutting element disposed within each blade proximate the leading edge section of the blade. The at least one cutting element having a substrate and a polycrystalline diamond material affixed to the substrate at an interface. The polycrystalline diamond material comprising a raised cutting surface having at least two cutting edges and first transition surfaces between the at least two cutting edges of the raised cutting surface and a longitudinal side surface of the cutting element. The first transition surfaces comprise multiple planar surfaces.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings. In the drawings:

DETAILED DESCRIPTION

Figure 1B:
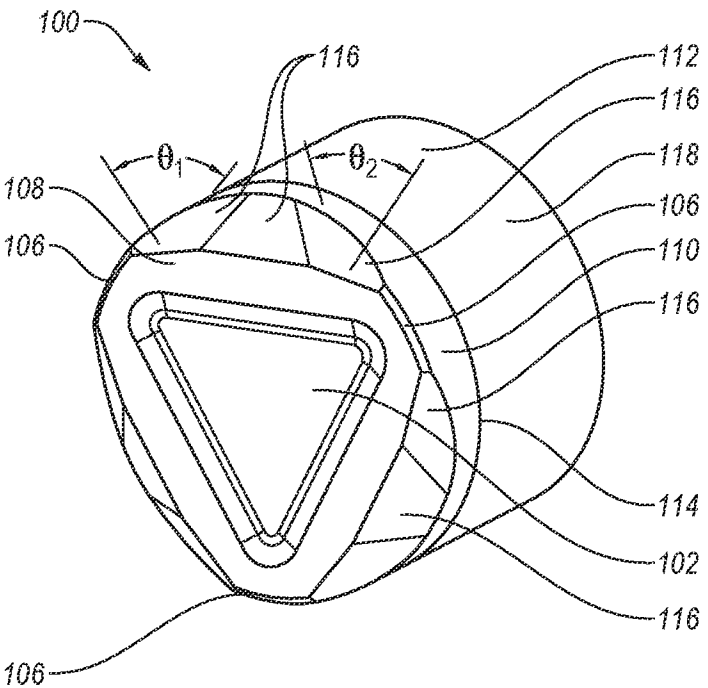
FIG. 1B is a rotated, perspective side view of the cutting element of FIG. 1A according to one or more embodiments of the present disclosure.

The illustrations presented herein are not meant to be actual views of any particular cutting element, earth-boring tool, or component thereof, but are merely idealized representations which are employed to describe embodiments of the disclosure. Thus, the drawings are not necessarily to scale.

Disclosed embodiments relate generally to geometries for cutting elements for earth-boring tools which may exhibit longer useful life, exhibit higher durability, and require lower energy input to achieve a target depth of cut and/or rate of penetration.

As used herein, the term "cutting elements" means and includes, for example, superabrasive (e.g., polycrystalline diamond compact or "PDC") cutting elements employed as fixed cutting elements, as well as tungsten carbide inserts and superabrasive inserts employed as cutting elements mounted to a body of an earth-boring tool.

As used herein, the singular forms following "a," "an," and "the" are intended to include the plural forms as well, unless the context clearly indicates otherwise.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, the term "substantially" in reference to a given parameter, property, or condition means and includes to a degree that one of ordinary skill in the art would understand that the given parameter, property, or condition is met with a degree of variance, such as within acceptable tolerances. By way of example, depending on the particular parameter, property, or condition that is substantially met, the parameter, property, or condition may be at least 90.0 percent met, at least 95.0 percent met, at least 99.0 percent met, at least 99.9 percent met, or even 100.0 percent met.

As used herein, the term "about" used in reference to a given parameter is inclusive of the stated value and has the meaning dictated by the context (e.g., it includes the degree of error associated with measurement of the given parameter, as well as variations resulting from manufacturing tolerances, etc.).

As used herein, the term "earth-boring tool" means and includes any type of bit or tool used for drilling during the formation or enlargement of a wellbore in a subterranean formation. For example, earth-boring tools include fixed-cutter bits, roller cone bits, percussion bits, core bits, eccentric bits, bicenter bits, reamers, mills, drag bits, hybrid bits (e.g., bits including rolling components in combination with fixed cutting elements), and other drilling bits and tools known in the art.

As used herein, the term "superabrasive material" means and includes any material having a Knoop hardness value of about 3,000 Kgf/mm2 (29,420 MPa) or more. Superabrasive materials include, for example, diamond and cubic boron nitride. Superabrasive materials may also be referred to as "superhard" materials.

As used herein, the term "polycrystalline material" means and includes any structure comprising a plurality of grains (e.g., crystals) of material that are bonded directly together by inter-granular bonds. The crystal structures of the individual grains of the material may be randomly oriented in space within the polycrystalline material.

As used herein, the terms "inter-granular bond" and "interbonded" mean and include any direct atomic bond (e.g., covalent, metallic, etc.) between atoms in adjacent grains of superabrasive material.

As used herein, terms of relative positioning, such as "above," "over," "under," and the like, refer to the orientation and positioning shown in the figures. During real-world formation and use, the structures depicted may take on other orientations (e.g., may be inverted vertically, rotated about any axis, etc.). Accordingly, the descriptions of relative positioning must be reinterpreted in light of such differences in orientation (e.g., resulting in the positioning structures described as being located "above" other structures underneath or to the side of such other structures as a result of reorientation).

As used herein, the term "flank angle" means and includes a smallest angle between a given transition surface and a plane at least substantially parallel to the raised cutting surface.

Figure 1A:
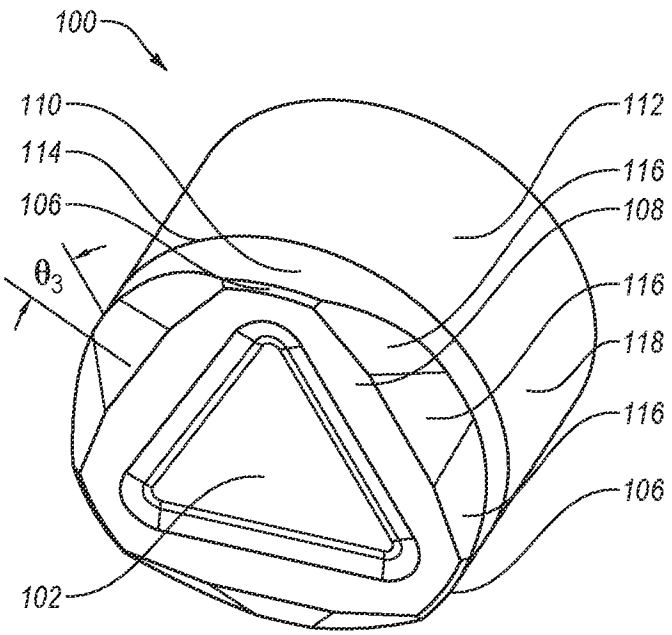
FIG. 1A is a perspective side view of a cutting element for an earth-boring tool having a table geometry according to one or more embodiments of the present disclosure.

FIGS. 1A and 1B are perspective side views of an embodiment of a cutting element 100 for an earth-boring tool in accordance with the present disclosure. The cutting element 100 includes a table 110 positioned and configured to engage with, and remove, an earth formation as the cutting element 100 is advanced toward the earth formation. The table 110 may include a polycrystalline, superabrasive material, such as, for example, polycrystalline diamond or cubic boron nitride. The table 110 may be secured to an end of a substrate 112, forming an interface 114 between the table 110 and the substrate 112. The substrate 112 may include a hard, wear-resistant material suitable for use in the downhole environment. For example, the substrate 112 may include a ceramic-metallic composite material (e.g., a cermet), including particles of a carbide or nitride material (e.g., tungsten carbide) in a matrix of a metal material (e.g., a solvent metal catalyst material configured to catalyze the formation of intergranular bonds among grains of the superabrasive material of the table 110).

The table 110 of the cutting element 100 may include a raised cutting surface 108 at a farthest distance from the substrate 112 having cutting edges 106 for positioning to first engage with the earth formation and located proximate to radially outermost portions of the table 110 with respect to a longitudinal axis of the cutting element 100. The table 110 may also include a recess 102 located proximate to a geometric center of the table 110 and positioned closer to the substrate 112 than the raised cutting surface 108. The table 110 may also include transition surfaces 116 extending from portions of the raised cutting surface 108 extending between the cutting edges 106 radially outward toward a periphery of the table 110 and longitudinally from the raised cutting surface 108 toward the substrate 112. Each respective portion of the table 110 located between the cutting edges 106 may include multiple transition surfaces 116. In some embodiments, the transition surfaces 116 may be planar, may extend over at least substantially the same longitudinal distance from the raised cutting surface 108 toward the substrate 112, and may extend along a respective portion of the angular distance around the perimeter of the table 110. Such transition surfaces 116 may present an angular, faceted, series of chamfer surfaces to render the transition between the cutting edges 106 around the perimeter of the table 110, and between the raised cutting surface 108 and a side surface 118 of the cutting element 100, more gradual.

In the embodiment specifically illustrated in FIGS. 1A and 1B, the raised cutting surface 108 is generally shaped as a triangle, having three cutting edges 106 proximate a side surface 118 of the cutting element 100 forming nodes of the substantially triangular shape, and three corresponding sides extending between the cutting edges 106. The transition surfaces 116 may cause what would otherwise be a planar surface extending from an edge at the perimeter of the cutting surface 108 between the cutting edges 106 to bow radially outward, such that the sides of the generally triangular cutting surface 108 are divided into multiple planar subsections, each planar subsection corresponding to an intersection of a given transition surface 116 with the raised cutting surface 108. In other embodiments, the raised cutting surface may have another substantially polygonal shape (e.g., rectangle, square, oval, rhombus, pentagon, etc.), with faceted transition surfaces 116 dividing the sides between major nodes of the polygonal shape into subsections. Variable flank angles for the transition surfaces 116 may reduce the cutter point loading of cutting forces during drilling while reducing the risk of torsional overloading in tougher to drill, higher depth of cut (DOC) applications. When deployed on an earth-boring tool, one of the cutting edges 106 at a node of the substantially polygonal shape of the raised cutting surface 108 may be oriented towards the formation material.

Cutting element 100 may include three different flank angles (e.g., first flank angle, second flank angle, and third flank angle) for each of the transition surfaces 116 oriented at different flank angles. The flank angles are the smallest angle between a given transition surface 116 and a plane at least substantially parallel to the raised cutting surface 108 of cutting element 100. Each one of the three different flank angles differs from the other flank angles.

FIG. 1A illustrates the three different flank angles of cutting element 100. A first flank angle $\theta_1$ may be between about 25 degrees and about 75 degrees. More specifically, the first flank angle $\theta_1$ may be, for example, between about 35 degrees and about 70 degrees. As a specific, nonlimiting example, the first flank angle $\theta_1$ may be between about 45 degrees and about 65 degrees (e.g., about 50 degrees, about 55 degrees, about 60 degrees). The second flank angle $\theta_2$ may be, for example, less than the first flank angle θ1, and between about 15 degrees and about 65 degrees. More specifically, the second flank angle $\theta_2$ may be, for example, between about 25 degrees and about 60 degrees. As a specific, nonlimiting example, the second flank angle $\theta_2$ may be between about 35 degrees and about 55 degrees (e.g., about 40 degrees, about 45 degrees, about 50 degrees). The third flank angle $\theta_3$ may be, for example, less than the first flank angle $\theta_1$ and less than the second flank angle $\theta_2$, and between about 1 degree and about 45 degrees. More specifically, the third flank angle $\theta_3$ may be, for example, between about 5 degrees and about 40 degrees. As a specific, nonlimiting example, the third flank angle $\theta_3$ may be between about 10 degrees and about 35 degrees (e.g., about 15 degrees, about 20 degrees, about 25 degrees).

Figure 2:
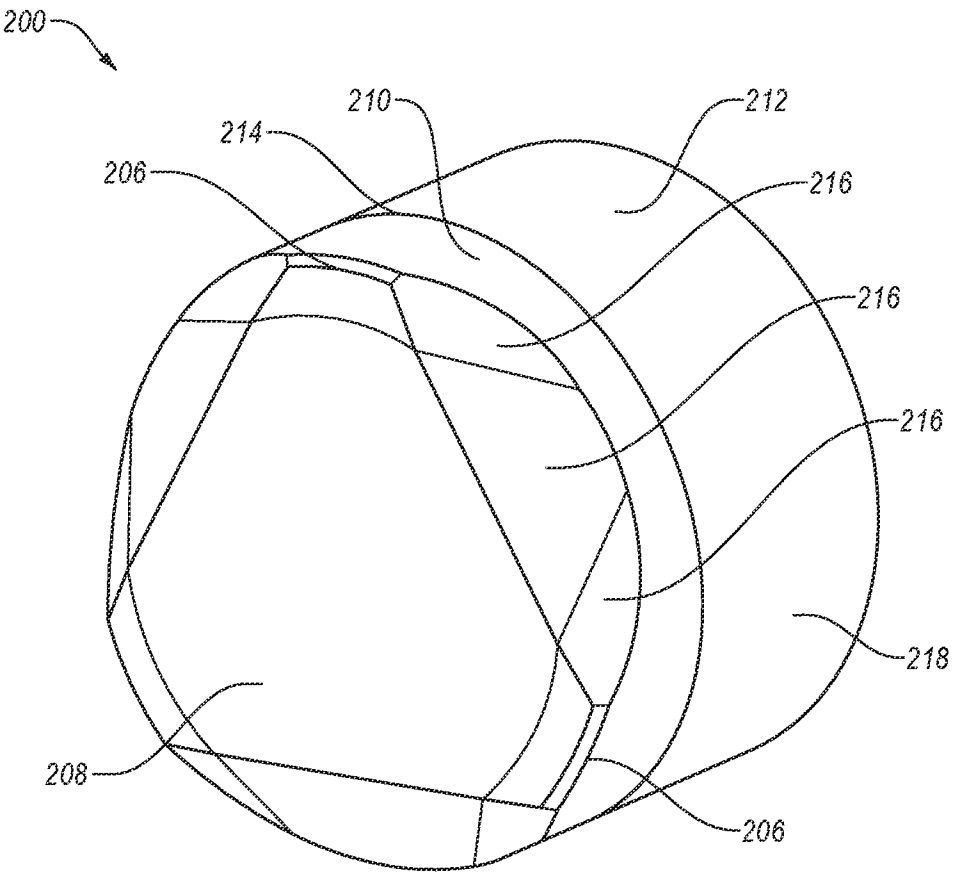
FIG. 2 is a perspective side view of a cutting element for an earth-boring tool according to one or more other embodiments of the present disclosure.

FIG. 2 is a perspective side view of another embodiment of a cutting element 200 in accordance with this disclosure. Similar to the cutting element 100 of FIGS. 1A and 1B, the cutting element 200 of FIG. 2 includes a raised cutting surface 208 having cutting edges 206, and transition surfaces 216 forming a faceted, chamfered transition around the perimeter of the cutting surface 208 between cutting edges 206. The raised cutting surface 208 is generally shaped as a triangle, having three cutting edges 206 proximate a side surface 218 of the cutting element 200 forming nodes of the substantially triangular shape, and three corresponding sides extending between the cutting edges 206. The transition surfaces 216 may cause what would otherwise be a planar surface extending from an edge at the perimeter of the cutting surface 208 between the cutting edges 206 and to the perimeter of the table 210 to bow radially outward, such that the sides of the generally triangular cutting surface 208 are divided into multiple planar subsections, each planar subsection corresponding to an intersection of a given transition surface 216 with the raised cutting surface 208. The cutting element 200 of FIG. 2 does not include the recess of cutting element 100 of FIGS. 1A and 1B.

Figure 3:
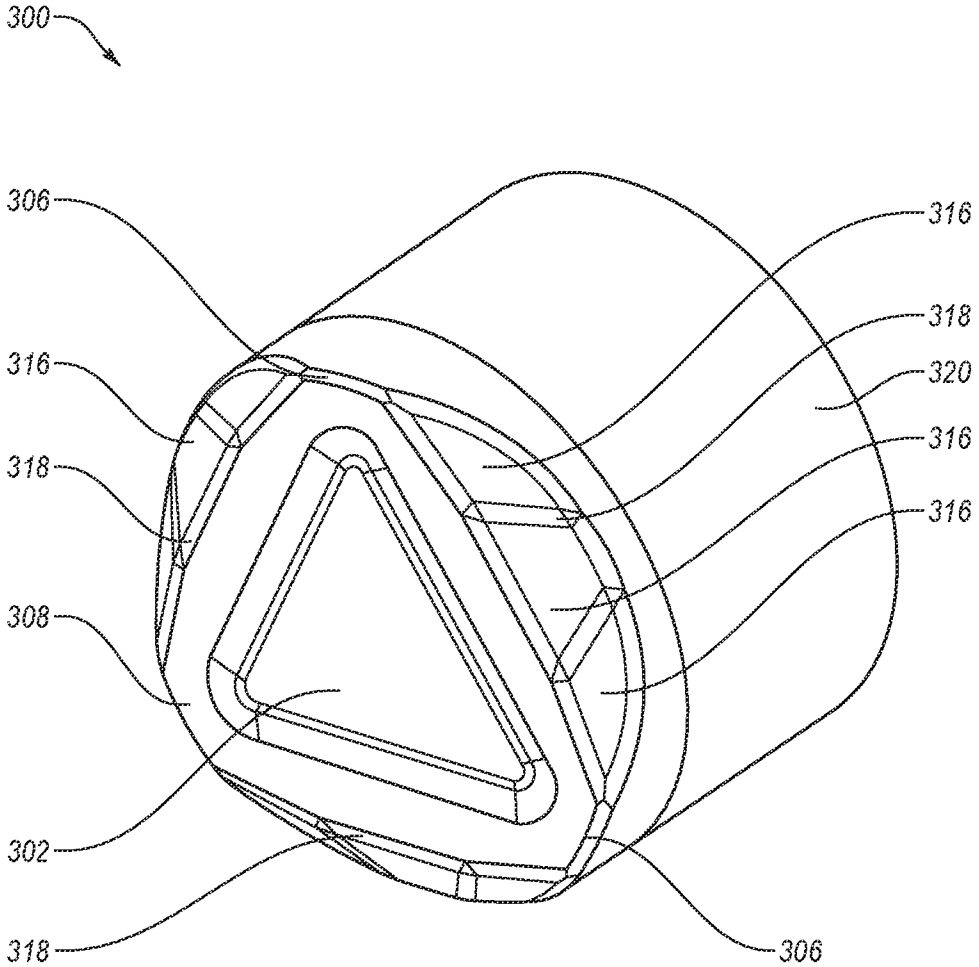
FIG. 3 is a perspective side view of a cutting element for an earth-boring tool according to one or more other embodiments of the present disclosure.

FIG. 3 is a perspective side view of another embodiment of a cutting element 300 in accordance with this disclosure. Similar to the cutting element 100 of FIGS. 1A and 1B, the cutting element 300 of FIG. 3 includes a raised cutting surface 308 having cutting edges 306, a recess 302, and transition surfaces 316 forming a faceted, chamfered transition around the perimeter of the cutting surface 308 between cutting edges 306. In the cutting element 300 of FIG. 3, the intersections between respective transition surfaces 316 may themselves include chamfers 318 or rounded (e.g., radiused) edges. In particular, each intersection between each of the transition surfaces 316 may be chamfered or curved. In addition, the intersections between the transition surfaces 316 and the raised cutting surface 308 may be chamfered or curved. The intersections between the transition surfaces 316 and the side surface 320 of the cutting element 300 (e.g., between the transition surfaces 316 and the perimeter of the table 110, between the transition surfaces and the substrate 112) may also be chamfered or curved. In some embodiments, recess 302 may be omitted from cutting element 300 similar to cutting element 200 of FIG. 2.

Figure 4:
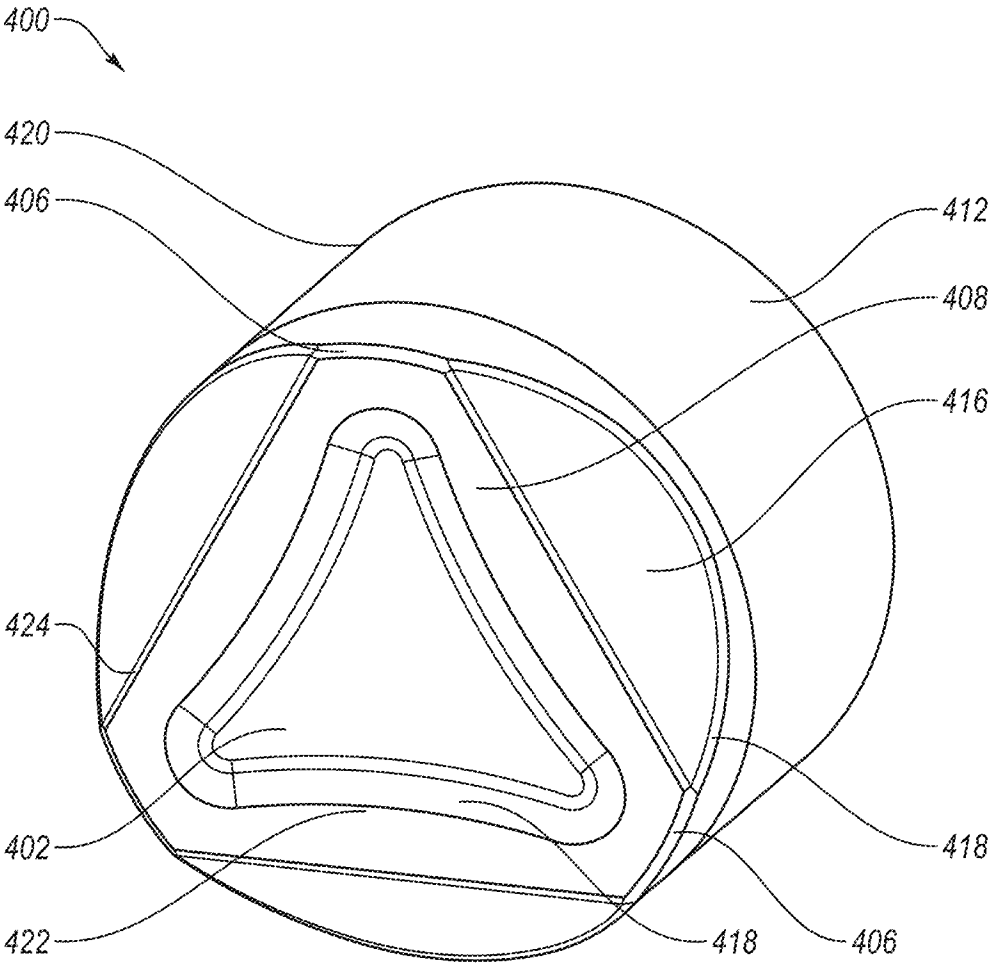
FIG. 4 is a perspective side view of a cutting element for an earth-boring tool according to one or more other embodiments of the present disclosure.

FIG. 4 is a perspective side view of another embodiment of a cutting element 400 in accordance with this disclosure. Similar to FIGS. 1A through 3, FIG. 4 illustrates a cutting element 400 including a raised cutting surface 408 having cutting edges 406 and a recess 402. Unlike FIGS. 1A through 3, the transition surfaces 416 depicted in FIG. 4 may be configured as discrete, continuous respective surfaces extending between the cutting edges 406. Such transition surfaces may cause the perimeter of the raised cutting surface 408 to conform more closely to the general polygonal shape it resembles, with at least substantially straight sides, each side formed by the intersection of a respective transition surface 416 with the raised cutting surface 408, extending between the nodes of the cutting edges 406. In some embodiments, recess 402 may be omitted from cutting element 400 similar to cutting element 200 of FIG. 2.

Similar to the cutting element 300 illustrated in FIG. 3, the transition surfaces 416 of the cutting element 400 of FIG. 4 may include chamfers 418 or rounded surfaces at the intersection between a given transition surface 416 and the cutting surface 408. In addition, the intersection between a given transition surface 416 and the side surface 420 of the cutting element 400 may be chamfered and/or curved.

In the embodiment illustrated in FIG. 4, the recess 402 located proximate to the geometrical center of the cutting element 400, and located closer to the substrate 412 than the raised cutting surface 408, may have a substantially triangular shape. The portions of the cutting surface 408 generally corresponding to three sides of the substantially triangular shape may have linear outer edges at intersections with the transition surfaces 416 (or at the chamfers 418 or curves transitioning thereto), and may have nonlinear inner edges at an intersection with another chamfer 418 or curve transitioning from the cutting surface 408 to the recess 402. For example, the raised cutting surface 408 may have a variable (e.g., non-constant) thickness in the regions extending between the cutting edges 406, as measured in a direction perpendicular to the outer edges 424 of the raised cutting surface 408. More specifically, the inner edges 422 of the cutting surface 408, as defined at an intersection of the cutting surface 408 with the chamfer 418 or curve transitioning to the recess 402, may be arcuate. As a specific, nonlimiting example, the inner edges 422 of the cutting surface 408 may be curved, may bow radially toward the geometric center of the recess 402, and may peak at least substantially at the midpoint between respective cutting edges 406, such that the thickest portion of the cutting surface 408 may be located at least substantially at that midpoint. In other embodiments, the interior edges of the raised cutting surface 408 adjacent to recess 402 (as illustrated in FIG. 4), may be linear (e.g., straight), may have a variable radius or a more complex shape, or may have a peak at a location other than the midpoint between cutting edges 406.

Figure 5:
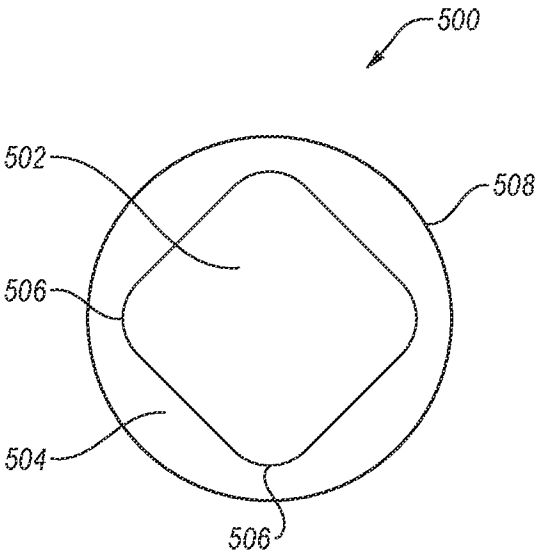
FIG. 5 is a top surface view of a face of a cutting element for an earth-boring tool, illustrating a recess having a substantially rectangular shape according to one or more other embodiments of the present disclosure.

FIG. 5 is a top surface view of a face 504 of another embodiment of a cutting element 500 for an earth-boring tool, illustrating a recess having a substantially rectangular shape. In the embodiment of FIG. 5, the cutting face 504 may not be raised, may be at least substantially planar, and may extend from a side surface 508 at a lateral periphery of the cutting element 500 radially inward. The cutting face 504 may terminate at a recess 502 located proximate to a geometric center of the cutting element 500. Recess 502 may be at least substantially rectangle shaped (e.g., substantially square shaped) with rounded corners 506. The surfaces that define recess 502 may be planar (oriented at any angle from 5° to 90° with respect to a longitudinal axis of the cutting element 500), may be curved (convex and/or concave) having an at least substantially constant or continuously variable radius (e.g., parabolic), or the surfaces may have a more complex curvature (such as a sinusoidal wave). In some embodiments, recess 502 may be omitted from cutting element 500 similar to cutting element 200 of FIG. 2.

Figure 6:
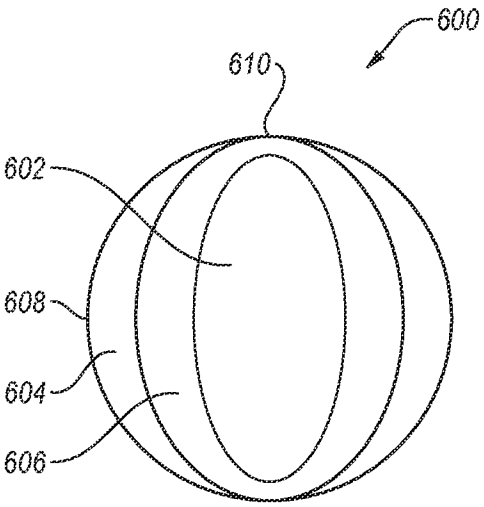
FIG. 6 is a top surface view of a face of a cutting element for an earth-boring tool, illustrating a recess and associated transition surface having a substantially oval shape according to one or more other embodiments of the present disclosure.

FIG. 6 is a top surface view of a face 604 of another embodiment of a cutting element 600 for an earth-boring tool. In this embodiment, the cutting face 606 of the cutting element 600 may be raised, may be at least substantially planar, and may only extend to a side surface 608 at a lateral periphery of the cutting element 600 proximate to cutting edges 610. The cutting face 606 may intersect with an outer transition surface 604 transitioning from the cutting face 604 longitudinally toward a substrate and radially outward from the cutting face 606 toward the side surface 608. The transition surface 606 may extend at an at least substantially constant angle from the cutting face 604 toward the substrate (e.g., may take the form of a chamfer), or may be curved from the cutting face 604 toward the substrate (e.g., at constant or variable radius), or may have a more complex transition geometry. The cutting element 600 may also include recess 602 located proximate to the geometric center of the cutting element 600, and positioned closer to the substrate than the cutting face 606. The recess 602 may generally be in the shape of an oval (e.g., an ellipse), and the raised cutting face 606 may likewise be at least substantially oval shaped (e.g., ellipse shaped). The thickness of the cutting face 606, as measured radially from a geometric center of the cutting element 600, may be at least substantially constant, or may vary (as shown in FIG. 6). In some embodiments, recess 602 may be omitted from cutting element 600 similar to cutting element 200 of FIG. 2.

Figure 7:
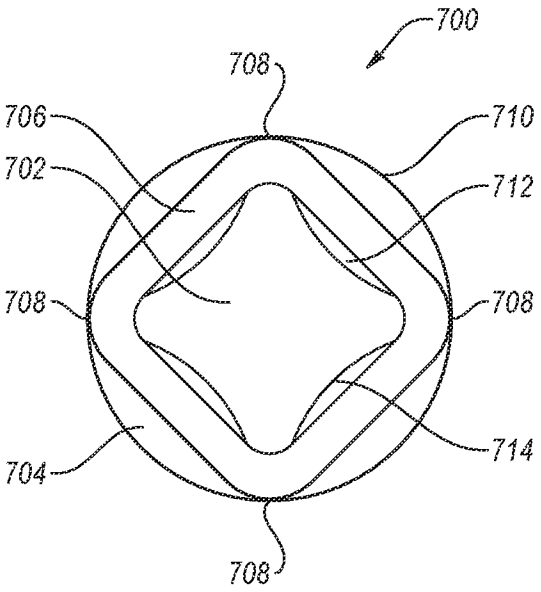
FIG. 7 is a top surface view of a face of a cutting element for an earth-boring tool, illustrating a cutting face having a substantially rectangular raised surface and a corresponding substantially rectangular recess according to one or more other embodiments of the present disclosure.

FIG. 7 is a top surface view of a face of another embodiment of a cutting element 700 for an earth-boring tool. In this embodiment, the cutting face 706 of the cutting element 700 may also be raised, may be at least substantially planar, and may only extend to a side surface 710 at a lateral periphery of the cutting element 700 proximate to cutting edges 708.

The cutting face 706 may intersect with an inner transition surface 712 transitioning from the cutting face 706 longitudinally toward a substrate to form a recess 702. The transition surface 712 may extend at an at least substantially constant angle from a planar bottom of the recess 702 to the cutting face 706 (e.g., may take the form of a chamfer), or may be curved from the planar bottom of the recess 702 to the cutting face 706 (e.g., at constant or variable radius), or may have a more complex transition geometry. In some embodiments, the inner edges of the transition surface 712 intersecting with the planar bottom surface of the recess 702 may be nonlinear. For example, the transition surface 712 may have a variable (e.g., non-constant) thickness in the regions extending between the nodes of the generally polygonal shape of the cutting surface 706, as measured in a direction perpendicular to the at least substantially linear edges of the cutting surface 706 extending between the cutting edges 708. More specifically, the inner edges 714 of the transition surfaces 712, as defined at intersections of the transition surface 712 with the planar bottom of the recess 702, may be arcuate. As a specific, nonlimiting example, the inner edges 714 of the transition surfaces 712 may be curved, may bow radially toward the geometric center of the recess 702, and may peak at least substantially at the midpoint between respective cutting edges 708, such that the thickest portion of the transition surfaces 712 may be located at least substantially at that midpoint. In other embodiments, the interior edges 714 of the inner transition surfaces 712 at the intersection with the planar bottom of the recess 702 (as illustrated in FIG. 7), may be linear (e.g., straight), may have a variable radius or a more complex shape, or may have a peak at a location other than the midpoint between cutting edges 708.

The cutting face 706 may also intersect with an outer transition surface 704, which may extend radially outward from the cutting face 706 to the side surface 710 and longitudinally from the cutting face 706 toward the substrate. The outer transition surfaces may take any of the forms, and have any of the configurations, described previously in connection with FIGS. 1A through 4.

The recess 702 may generally be in the shape of a rectangle (e.g., a square), and the cutting surface 606 may likewise be at least substantially rectangle shaped (e.g., square shaped). In some embodiments, recess 702 may be omitted from cutting element 700 similar to cutting element 200 of FIG. 2.

Figure 8:
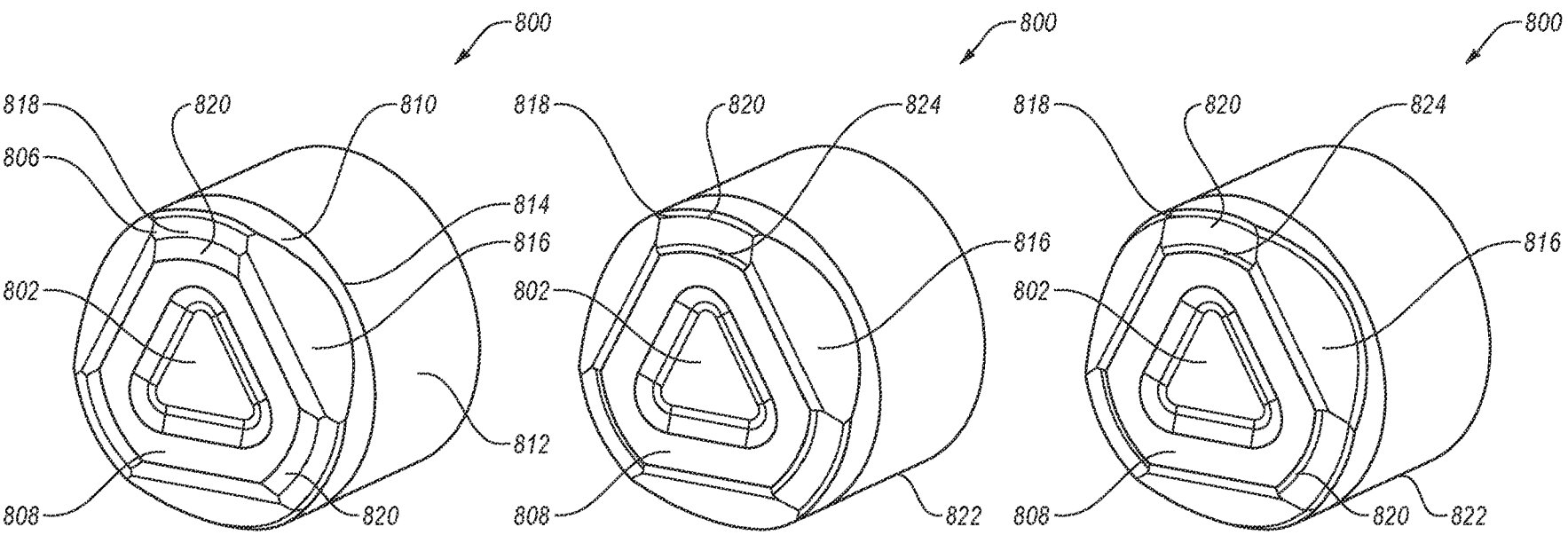
FIG. 8 is a series of perspective side views of cutting elements for earth-boring tools according to one or more other embodiments of the present disclosure.

FIG. 8 is a series of perspective side views of other embodiments of cutting elements 800 for earth-boring tools. In the depicted embodiments, the cutting element 800 may be configured to include a raised cutting surface 808 having cutting edges 806, a recess 802 in the center of the raised cutting surface 808, and transition surfaces 816 extending from portions of the cutting surface 808 at the outer periphery thereof toward the substrate 812. The transition surfaces 816 may extend from the raised cutting surface 808 to a side surface 822 of the cutting element 800, which may be within the table 810 itself or at the interface 814 with the substrate 812.

As shown in each view of FIG. 8, the cutting element 800 may include a first chamfered edge 818 at the cutting edge 806 of the cutting element 800. The first chamfered edge 818 may extend around an entire circumference of the table 810, forming a transition between the side surface 822 and the cutting edge 806, as well as between the side surface 822 and the transition surfaces 816. The table 810 may also include a secondary chamfer 820 between the first chamfered edge 818 and the raised cutting surface 808 proximate to the cutting edges 806. The secondary chamfer 820 may intersect laterally with, and generally traverse the same longitudinal distance as, the transition surfaces 816. For example, the secondary chamfer 820 and the transition surfaces may collectively form a faceted transition from the first chamfer 818 longitudinally toward the cutting face 808 and radially inward toward the geometric center of the cutting element 800. In addition, the two embodiments on the right-hand side of FIG. 8 illustrate a third chamfer 824 between the secondary chamfer 820 and the raised cutting surface 808. The third chamfer 824 may likewise extend around an entire circumference of the table 810, forming a gradual transition from the secondary chamfer 820 and from the transition surfaces 816 to the cutting face 808. Each of the transition surface 816, first chamfered edge 818, secondary chamfer 820, and third chamfer 824 may take the form of a planar surface or an arcuate surface (e.g., concave or convex) transitioning longitudinally and radially between the identified bordering features. As shown in the various views of FIG. 8, the transition surface 816, first chamfered edge 818, secondary chamfer 820, and third chamfer 824 may be adapted to cover differing longitudinal and radial extents, forming shorter, taller, wider, and/or narrower features, depending on the specific configuration desired. Chamfered edges, such as those described in connection with FIG. 8, have been found to reduce thumbnail cracking and tangential overload when compared to certain other geometries known to the inventors, and reduce the tendency of the polycrystalline, superabrasive material of the table 810 to spall and fracture. In some embodiments, recess 802 may be omitted from cutting element 800 similar to cutting element 200 of FIG. 2.

Figure 9:
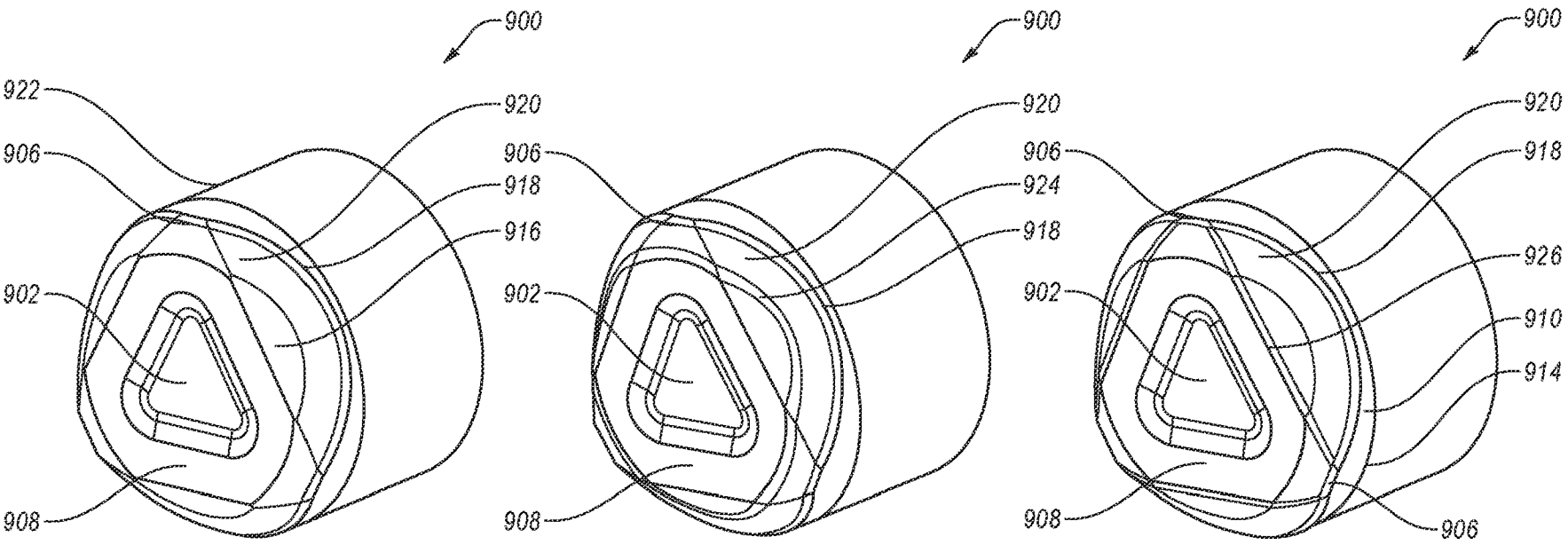
FIG. 9 is a series of perspective side views of cutting elements for earth-boring tools according to one or more other embodiments of the present disclosure.

FIG. 9 is a series of perspective side views of other embodiments of cutting elements 900 for earth-boring tools. The cutting element 900 may include a raised cutting surface 908 having cutting edges 906, a recess 902, and transition surfaces 916. The various views of FIG. 9 also illustrate that the cutting element may include a multi-angled full edge first chamfer 918 and a multi-angled full edge second chamfer 920. The first chamfer 918 may extend around an entire circumference of the table 910, and may form a sloped or curved transition between the side surface 922 of the cutting element 900 and the second chamfer 920. The cutting edge 906 may be formed by the first chamfer 918 in some embodiments, at the intersection between the first chamfer 918 and the side surface 922 of the cutting element 900. In some embodiments, recess 902 may be omitted from cutting element 900 similar to cutting element 200 of FIG. 2.

The second chamfer 920 may likewise extend around the entire circumference of the table 910, and may form a sloped or curved transition between the first chamfer 918 and a third chamfer 924 or between the first chamfer 918 and the transition surface 916 and between the first chamfer 918 and the cutting surface 908. The central view of FIG. 9 also illustrates a multi-angled full edge third chamfer 924, which may extend around the entire circumference of the table 910, and form a sloped or curved transition between the second chamfer 920 and the transition surface 916 and between the second chamfer 920 and the cutting surface 908.

The right-hand view of FIG. 9 illustrates a fourth chamfer 926 for the generally polygonal shape of the cutting face 908. For example, the fourth chamfer 926 may be located at the perimeter of the outer edge of the at least substantially triangular shape of the cutting face 908, and may form a sloped or curved transition between the transition surface 916 and the cutting face 908 and between the portion of the second chamfer 920 located proximate to the transition surface 916 and the portion of the second chamfer 920 located proximate to the cutting edge 906.

The geometries of the several views of FIG. 9 may produce a sharp cutting edge 906 at the beginning of an earth-boring operation. As the cutting element 900 wears, the effective cutting edge may wear through the first chamfer 918, into the second chamfer 920, into the third chamfer 924 in embodiments including such a feature, and ultimately into the cutting face 908. While the width of the effective cutting edge may gradually increase as this wear and transition occurs, the width of the effective cutting edge may remain sharper when compared to conventional designs for cutting elements known to the inventors. The geometries for the cutting elements 900 shown in FIG. 9 may also reduce internal stresses induced during cutting, increase fracture and wear resistance, and otherwise improve cutting efficiency. For example, the multi-angle full edge chamfers 918, 920, and 924, along with the planar transition surfaces 916, and chamfers may improve the flow of fluid around the cutting element 900, increasing the efficiency of cutting removal, more effectively cooling the cutting element 900, and increasing the efficiency and durability of the cutting element 900.

Where logically possible, the features of the cutting elements shown and described in connection with FIGS. 1A through 9 may be combined with one another. For example, the faceted transition surfaces 116 shown in FIGS. 1A and 1B may be implemented on any of the cutting elements shown in FIGS. 4 through 9. As another example, the chamfers 318 between faceted transition surfaces 316 shown in FIG. 3 may be implemented on any of the cutting elements of FIGS. 4 through 9, assuming they include the faceted transition surfaces 316 themselves. As yet another example, the nonlinear inner edges 422 shown in FIG. 4 may be utilized for any of the inner edges for polygonal cutting faces shown in FIGS. 1A through 3 and 5 through 9. As other examples, the rectangular and oval shapes for cutting faces and recesses shown in FIGS. 5 through 7 may be utilized instead of the generally triangular shapes shown in FIGS. 1A through 4, 8, and 9. Finally, the various chamfering configurations, including full-edge chamfers, variations in longitudinal and radial distances covered, and extensions of the generally polygonal shapes into the chamfered regions shown in FIGS. 8 and 9 may be utilized with any of the cutting element designs shown and described in connection with FIGS. 1A through 7.

Figure 10:
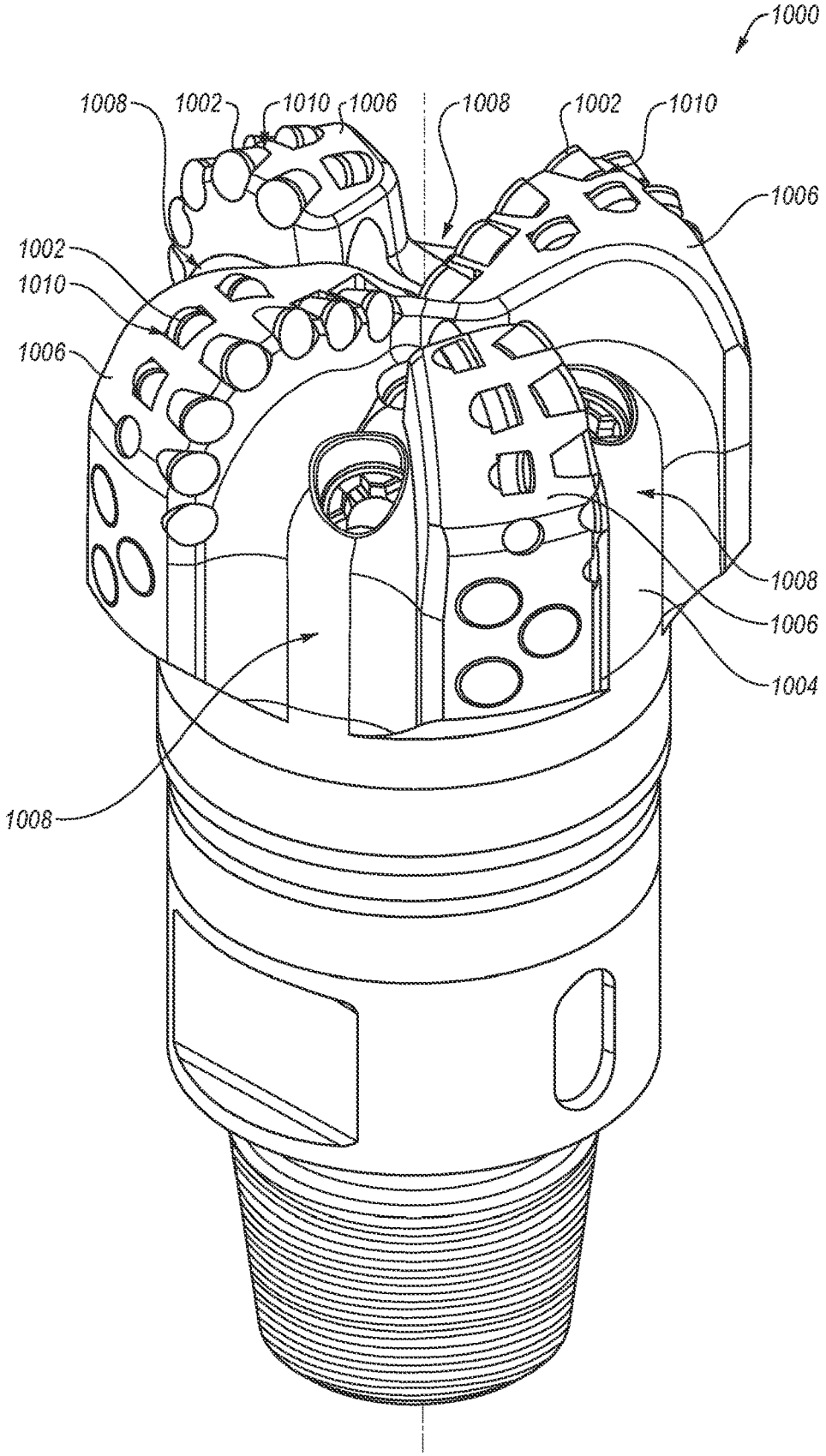
FIG. 10 is a perspective side view of an earth-boring tool including one or more cutting elements in accordance with the present disclosure.

FIG. 10 is a perspective view of an earth-boring tool 1000 including one or more cutting elements 1002, which may be configured as any of the embodiments shown in connection with FIGS. 1A through 9, or any possible combination of their features, as described above. For the sake of simplicity, the cutting elements 1002 have been illustrated as having planar cutting faces, but at least one of the cutting element 1002, up to all of the cutting elements 1002, may have the complex geometries described above. The earth-boring tool 1000 may include a body 1004 to which the cutting element (s) 1002 may be secured. The earth-boring tool 1000 specifically depicted in FIG. 10 is configured as a fixed-cutter earth-boring drill bit, including blades 1006 projecting outward from a remainder of the body 1004 and defining junk slots 1008 between rotationally adjacent blades 1006. In such an embodiment, the cutting element(s) 1002 may be secured partially within pockets 1010 extending into one or more of the blades 1006 (e.g., proximate the rotationally leading portions of the blades 1006 as primary cutting elements 1002, rotationally following those portions as backup cutting elements 1002, or both). However, cutting elements 1002 as described herein may be bonded to and used on other types of earth-boring tools, including, for example, roller cone drill bits, percussion bits, core bits, eccentric bits, bi-center bits, reamers, expandable reamers, mills, hybrid bits, and other drilling bits and tools known in the art.

The modified geometries of the embodiments described above are expected to mitigate thumbnail cracking and tangential overload when compared to geometries for other cutting elements known to the inventors. Furthermore, modified geometries of the embodiments described above contain critical angled faces to maintain cutting efficiency while allowing for increased durability. The modified geometries of the embodiments described above will allow for greater use in higher weight and torque drilling environments.

Additional non-limiting example embodiments of the disclosure are described below.

Embodiment 1: A cutting element comprising a substrate and a polycrystalline diamond material affixed to the substrate at an interface. The polycrystalline diamond material comprising a raised cutting surface comprising at least two cutting edges, and first transition surfaces between the at least two cutting edges of the raised cutting surface and a longitudinal side surface of the cutting element, wherein the first transition surfaces comprise multiple planar surfaces.

Embodiment 2: The cutting element of Embodiment 1, further comprising a recess in a center of the raised cutting surface.

Embodiment 3: The cutting element of Embodiment 2, further comprising second transition surfaces between edges of the raised cutting surfaces and a bottom surface of the recess.

Embodiment 4: The cutting element of Embodiment 2 or Embodiment 3, wherein one or more edges between the raised cutting surface and the second transition surfaces are linear.

Embodiment 5: The cutting element of Embodiment 2 or Embodiment 3, wherein one or more edges between the raised cutting surface and the second transition surfaces comprise one or more arcs.

Embodiment 6: The cutting element of Embodiment 2 or Embodiment 3, wherein edges between the raised cutting surface and the second transition surfaces are chamfered.

Embodiment 7: The cutting element of Embodiment 1 through 6, wherein at least one edge of the raised cutting surface comprises a chamfered edge.

Embodiment 8: The cutting element of Embodiment 1 through 7, wherein the at least two cutting edges of the raised cutting surface are chamfered.

Embodiment 9: The cutting element of Embodiments 1 through 8, wherein edges between the longitudinal side surface of the cutting element and the first transition surfaces are chamfered.

Embodiment 10: The cutting element of Embodiments 1 through 9, wherein edges between the raised cutting surface and the first transition surfaces are chamfered.

Embodiment 11: The cutting element of Embodiments 1 through 10, wherein one or more edges between the raised cutting surface and the second transition surfaces are linear.

Embodiment 12: The cutting element of Embodiments 1 through 11, wherein one or more edges between the raised cutting surface and the first transition surfaces comprise one or more arcs.

Embodiment 13: The cutting element of Embodiments 1 through 12, wherein the raised cutting surface comprises at least three cutting edges.

Embodiment 14: The cutting element of Embodiments 1 through 13, wherein the raised cutting surface comprises at least four cutting edges.

Embodiment 15: A method of manufacturing an earth-boring tool comprising forming a drill bit body, forming at least one blade extending from one end of the drill bit body. The at least one blade comprising a leading edge section. Forming at least one cutting element in each at least one blade proximate the leading edge section of the at least one blade. Forming the at least one cutting element comprises forming a polycrystalline diamond material, affixing a first end of the polycrystalline diamond material at an interface to a substrate, and shaping a second end of the polycrystalline diamond material. Shaping the second end of the polycrystalline diamond material comprises forming at least two cutting edges defining a raised cutting surface, and forming first transition surfaces between the at least two cutting edges of the raised cutting surface and a longitudinal side surface of the cutting element, wherein the first transition surfaces comprise multiple planar surfaces.

Embodiment 16: The method of Embodiment 15, further comprising forming a recess in a center of the raised cutting surface.

Embodiment 17: The method of Embodiment 16, further comprising forming second transition surfaces between edges of the raised cutting surface and a bottom surface of the recess.

Embodiment 18: An earth-boring tool comprising a bit body, a plurality of blades extending from one end of the body, each blade comprising a leading edge section, at least one cutting element disposed within each blade proximate the leading edge section of the blade. The at least one cutting element comprising a substrate and a polycrystalline diamond material affixed to the substrate at an interface. The polycrystalline diamond material comprising a raised cutting surface comprising at least two cutting edges and first transition surfaces between the at least two cutting edges of the raised cutting surface and a longitudinal side surface of the cutting element. The first transition surfaces comprise multiple planar surfaces.

Embodiment 19: The earth-boring tool of Embodiment 18, further comprising a recess in a center of the raised cutting surface.

Embodiment 20: The cutting element of Embodiment 19, wherein a bottom surface of the recess is positioned closer to the substrate than the raised cutting surface.

While certain illustrative embodiments have been described in connection with the figures, those of ordinary skill in the art will recognize and appreciate that the scope of this disclosure is not limited to those embodiments explicitly shown and described in this disclosure. Rather, many additions, deletions, and modifications to the embodiments described in this disclosure may be made to produce embodiments within the scope of this disclosure, such as those specifically claimed, including legal equivalents. In addition, features from one disclosed embodiment may be combined with features of another disclosed embodiment while still being within the scope of this disclosure.

What is claimed is:

1. A cutting element comprising:

a substrate; and a table composed of polycrystalline diamond material, the table affixed to the substrate at an interface, the table comprising:

a raised cutting surface at least partially defined by and extending between at least two cutting edges, the raised cutting surface being planar and extending substantially orthogonally to a longitudinal center axis of the cutting element;

a longitudinal side surface at a periphery of the table;

first planar transition surfaces extending radially outward from portions of the raised cutting surface to the longitudinal side surface;

wherein a plurality of the first planar transition surfaces is between two adjacent cutting edges, and wherein the first planar transition surfaces connect the portions of the raised cutting surface to an entirety of a portion of the longitudinal side surface between the at least two cutting edges, each of the at least two cutting edges comprising a chamfer surface located directly between and intersecting the raised cutting surface and the longitudinal side surface and extending circumferentially a distance along a perimeter of the raised cutting surface.

2. The cutting element of claim 1, further comprising a recess in a center of the raised cutting surface.

3. The cutting element of claim 2, further comprising second planar transition surfaces between edges of the raised cutting surface and a bottom surface of the recess.

4. The cutting element of claim 3, wherein one or more edges between the raised cutting surface and the second planar transition surfaces are linear.

5. The cutting element of claim 3, wherein one or more edges between the raised cutting surface and the second planar transition surfaces comprise one or more arcs.

6. The cutting element of claim 3, wherein edges between the raised cutting surface and the second planar transition surfaces are chamfered.

7. The cutting element of claim 1, wherein at least one edge of the raised cutting surface comprises a chamfered edge.

8. The cutting element of claim 1, wherein the at least two cutting edges of the raised cutting surface are chamfered.

9. The cutting element of claim 1, wherein edges between the longitudinal side surface of the cutting element and the first planar transition surfaces are chamfered.

10. The cutting element of claim 1, wherein edges between the raised cutting surface and the first planar transition surfaces are chamfered.

11. The cutting element of claim 1, wherein one or more edges between the raised cutting surface and the first planar transition surfaces are linear.

12. The cutting element of claim 1, wherein one or more edges between the raised cutting surface and the first planar transition surfaces comprise one or more arcs.

13. The cutting element of claim 1, wherein the raised cutting surface is at least partially defined by and extends between at least three cutting edges.

14. The cutting element of claim 1, wherein the raised cutting surface is at least partially defined by and extends between at least four cutting edges.

15. A method of manufacturing an earth-boring tool comprising:

forming a drill bit body;

forming at least one blade extending from one end of the drill bit body, the at least one blade comprising a leading edge section; and forming at least one cutting element in each at least one blade proximate the leading edge section of the at least one blade, wherein forming the at least one cutting element comprises:

forming a table comprising polycrystalline diamond material;

affixing a first end of the table at an interface to a substrate;

forming a longitudinal side surface at a periphery of the table; and shaping a second end of the table, comprising:

forming at least two cutting edges at least partially defining a raised cutting surface, the raised cutting surface being planar, extending between the at least two cutting edges, and extending substantially orthogonally to a longitudinal center axis of the at least one cutting element; and forming first planar transition surfaces extending radially outward from portions of the raised cutting surface to the longitudinal side surface, wherein a plurality of the first planar transition surfaces is between two adjacent cutting edges, and wherein the first planar transition surfaces connect the portions of the raised cutting surface to an entirety of a portion of the longitudinal side surface of between the at least two cutting edges, each of the at least two cutting edges comprising a chamfer surface located directly between and intersecting the raised cutting surface and the longitudinal side surface and extending circumferentially a distance along a perimeter of the raised cutting surface.

16. The method of claim 15, further comprising forming a recess in the center of the raised cutting surface.

17. The method of claim 16, further comprising forming second planar transition surfaces between edges of the raised cutting surface and a bottom surface of the recess.

18. An earth-boring tool comprising:

a bit body;

a plurality of blades extending from one end of the body, each blade comprising a leading edge section; and at least one cutting element disposed within each blade proximate the leading edge section of the blade, the at least one cutting element comprising:

a substrate; and a table composed of polycrystalline diamond material, the table affixed to the substrate at an interface, the table comprising:

a raised cutting surface at least partially defined by and extending between at least two cutting edges, the raised cutting surface being planar and extending substantially orthogonally to a longitudinal center axis of the cutting element;

a longitudinal side surface at a periphery of the table;

first planar transition surfaces extending radially outward from portions of the raised cutting surface to the longitudinal side surface, wherein a plurality of the first planar transition surfaces is positioned between two adjacent cutting edges, and wherein the first planar transition surfaces connect the portions of the raised cutting surface to the entire an entirety of a portion of the longitudinal side surface of the table between the at least two cutting edges, each of the at least two cutting edges comprising a chamfer surface located directly between and intersecting the raised cutting surface and the longitudinal side surface and extending circumferentially a distance along a perimeter of the raised cutting surface.

19. The earth-boring tool of claim 18, further comprising a recess in a center of the raised cutting surface.

20. The earth-boring tool of claim 19, wherein a bottom surface of the recess is positioned closer to the substrate than the raised cutting surface.

* * * * *